US007909916B2

(12) United States Patent
Ohya et al.

(10) Patent No.: US 7,909,916 B2
(45) Date of Patent: Mar. 22, 2011

(54) MAINTENANCE METHOD FOR PARTICULATE FILTER

(75) Inventors: Toshiki Ohya, Hino (JP); Toshikatsu Muramatsu, Hino (JP); Eiji Kunishima, Hino (JP); Jun Ozawa, Yokohama (JP)

(73) Assignees: Hino Motors, Ltd., Tokyo (JP); Tokyo Roki Co., Ltd., Yokohama-shi (JP)

( * ) Notice: Subject to any disclaimer, the term of this patent is extended or adjusted under 35 U.S.C. 154(b) by 317 days.

(21) Appl. No.: 12/095,982

(22) PCT Filed: Dec. 5, 2006

(86) PCT No.: PCT/JP2006/324208

§ 371 (c)(1),
(2), (4) Date: Jun. 3, 2008

(87) PCT Pub. No.: WO2007/066632

PCT Pub. Date: Jun. 14, 2007

(65) Prior Publication Data

US 2009/0241780 A1 Oct. 1, 2009

(30) Foreign Application Priority Data

Dec. 6, 2005 (JP) ..... 2005-351831

(51) Int. Cl.
*B01D 46/04* (2006.01)

(52) U.S. Cl. ..... 95/280; 55/523; 55/302; 422/177

(58) Field of Classification Search ..... 55/302, 55/523, DIG. 30; 60/311; 95/279, 280; 422/177
See application file for complete search history.

(56) References Cited

U.S. PATENT DOCUMENTS

| | | | | |
|---|---|---|---|---|
| 4,730,454 | A * | 3/1988 | Pischinger et al. | 60/274 |
| 5,013,341 | A * | 5/1991 | Isaksson et al. | 55/302 |
| 5,318,755 | A * | 6/1994 | Kuivalainen et al. | 422/171 |
| 5,566,545 | A * | 10/1996 | Hijikata et al. | 60/274 |
| 5,595,581 | A * | 1/1997 | Ichikawa et al. | 55/302 |
| 6,582,490 | B2 * | 6/2003 | Miller et al. | 55/520 |
| 6,974,490 | B2 * | 12/2005 | Gillingham et al. | 55/486 |
| 7,410,521 | B2 * | 8/2008 | Sellers et al. | 55/523 |
| 7,442,218 | B2 * | 10/2008 | Okubo et al. | 55/282.3 |
| 7,462,222 | B2 * | 12/2008 | Sellers et al. | 95/279 |

FOREIGN PATENT DOCUMENTS

| | | |
|---|---|---|
| EP | 1 473 446 A1 | 11/2004 |
| JP | 7 332064 | 12/1995 |
| JP | 9 155131 | 6/1997 |
| JP | 2003 97248 | 4/2003 |
| JP | 2004 239072 | 8/2004 |

* cited by examiner

*Primary Examiner* — Duane Smith
*Assistant Examiner* — Thomas Bennett McKenzie
(74) *Attorney, Agent, or Firm* — Oblon, Spivak, McClelland, Maier & Neustadt, L.L.P.

(57) ABSTRACT

Provided is a method for performing maintenance of a particulate which can reliably remove combustion residue by means of backwash air without use of hot water and the like while cutting equipment expenses, so that substantial increase in exhaust pressure and deterioration of fuel economy during operation can be prevented.

When maintenance of the particulate filter 4 is to be performed, a filler 13 is filled to each of passages 8 with outlets unplugged with plugs 9 so as to reduce an inner volume of the passage 8, and then backwash air 12 is blown into the passages 8 with the unplugged outlets.

4 Claims, 6 Drawing Sheets

DURING MAINTENANCE

DURING MAINTENANCE

DURING MAINTENANCE

DURING MAINTENANCE

MAINTENANCE METHOD FOR PARTICULATE FILTER

TECHNICAL FIELD

The present invention relates to a method for performing maintenance of a particulate filter.

BACKGROUND ART

Particulates or particulate matter from a diesel engine is mainly constituted by carbonic soot and a soluble organic fraction (SOF) of high-boiling hydrocarbon and contains a trace of sulfate (misty sulfuric acid fraction). In order to suppress such kind of particulates from being discharged to atmosphere, it has been carried out as shown in FIG. 1 that a particulate filter 4 is incorporated in an exhaust pipe 3 through which exhaust gas 2 flows from a diesel engine 1.

The particulate filter 4 is accommodated in a casing 5. Arranged in the casing 5 on an entry side of the particulate filter 4 is a fore oxidation catalyst 6.

As shown in (a) of FIG. 2, the particulate filter 4 comprises a filter body 7 in the form of a porous honeycomb structure made of ceramics such as cordierite and having lattice-like compartmentalized passages 8. Alternate ones of the passages 8 in the filter body 7 are plugged at their inlets with plugs 9 and the remaining passages with unplugged open inlets are plugged at their outlets with the plugs 9. Thus, only the exhaust gas 2 passing through porous thin walls 10, which compartmentalize the passages 8, is discharged downstream, particulates being captured on inner surfaces of the thin walls 10.

The particulates having been entrained in the exhaust gas 2 and captured by and accumulated on the inner surfaces of the thin walls 10 require to be appropriately burned off so as to regenerate the particulate filter 4 before exhaust resistance increases considerably due to clogging. However, the exhaust gas from the engine 1 in a normal operating status rarely has a chance to reach a temperature level at which the particulates spontaneously ignite. Thus, it has been developed into practical use that, in combination with the fore oxidation catalyst 6 arranged on the entry side of the particulate filter 4 in the casing 5 as mentioned in the above, used as the particulate filter 4 is a catalytic regenerative particulate filter 4 with an oxidation catalyst integrally carried by the filter body 7, said oxidation catalyst comprising, for example, alumina which carries platinum and is added with an appropriate amount of rare-earth element such as cerium.

Such combined use of the fore oxidation catalyst 6 with the catalytic regenerative particulate filter 4 accelerates oxidation reaction of the captured particulates to lower the ignition temperature, so that the particulates can be burned off even at the exhaust gas temperature lower than ever before.

However, in the particulate filter 4, the exhaust gas 2 flowing through the respective passages 8 stagnates to be lowered in flow rate just before the plugs 9 in the outlets, so that liable to be gradually deposited especially in this area is ash 11 generated by in-cylinder combustion due to additives in the lubricant and sulfur content in the fuel. The ash 11 as combustion residue requires to be periodically washed out in a maintenance operation of the particulate filter 4 since the ash accumulated too much may bring about substantial increase in exhaust pressure and deterioration of fuel economy.

As a specific way of washing the particulate filter 4, it has been proposed to wash out the combustion residue by jetting hot water under high pressure to the particulate filter 4 which is detached from the exhaust pipe 3 (see, for example, Reference 1).

[Reference 1] JP 2004-239072A

SUMMARY OF THE INVENTION

Problems to be Solved by the Invention

However, the washing of the particulate filter 4 by hot water as mentioned in the above is disadvantageous in that the hot water is consumed in large quantity and resultant wastewater must be treated as industrial waste and that the washed particulate filter 4 must be dried, leading to necessity of huge facilities and resulting in great deal of equipment expenses.

In order to overcome such drawbacks, it has been conventionally conducted as shown in (b) of FIG. 2 in a maintenance operation to erect the casing 5, which is detached from the exhaust pipe 3, with its downstream end in the direction of flow of the exhaust gas 2 directed upward and to blow backwash air 12 into a downstream end of the particulate filter 4 in the direction of flow of the exhaust gas 2, i.e., into outlets of the passages 8 unplugged with the plugs 9 so as to remove the ash 11 as combustion residue.

However, mere blowing of the backwash air 12 into the downstream end of the particulate filter 4 in the direction of flow of the exhaust gas 2 as mentioned in the above results in outflow of the air 12 mainly through inlet-side portions of the porous thin walls 10 where no ash 11 is accumulated, failing in sufficient removal of the ash 11.

While FIG. 1 and (a) and (b) of FIG. 2 show the example with the fore oxidation catalyst 6 arranged on the entry side of the particulate filter 4 in the casing 5, (a) and (b) of FIG. 3 show an example with only the particulate filter 4 accommodated in the casing 5 and with no oxidation catalyst 6 on the entry side of the particulate filter 4. Also in the latter case, just like the above, mere blowing of the backwash air 12 into the downstream end of the particulate filter 4 in the direction of flow of the exhaust gas 2 results in outflow of the air 12 mainly through inlet-side portions of the porous thin walls 10 where no ash 11 is accumulated, failing in sufficient removal of the ash 11.

The invention was made in view of the above and has its object to provide a method for performing maintenance of a particulate filter which can reliably remove the combustion residue by means of the backwash air without use of hot water and the like while cutting equipment expenses, thereby preventing substantial increase in exhaust pressure and deterioration of fuel economy during an operation.

Means or Measures for Solving the Problems

The invention is directed to a method for performing maintenance of a particulate filter, said particulate filter comprising a honeycomb filter body made of porous material and having mutually adjacent passages with plugged inlets and passages with plugged outlets, exhaust gas guided into the passages with the plugged outlets passing through porous thin walls to the passages with the plugged inlets, thereby capturing particulates entrained in the exhaust gas, characterized by filling a filler to each of the passages having the unplugged outlets so as to reduce an inner volume of the passage, and then blowing backwash air into the passages having the unplugged outlets.

According to the above means, the following will be obtained.

When maintenance of a particulate filter is to be performed, as mentioned in the above, each of the passages with unplugged outlets is filled with a filler so as to reduce an inner volume of the passage and then backwash air is blown into the passages with the unplugged outlets, so that areas of porous thin walls through which the backwash air can pass are decreased such that the backwash air reliably passes through portions of the thin walls where combustion residue such as ash is accumulated. Thus, unlike conventional mere blowing of backwash air through the downstream end of the particulate filter in the direction of flow of the exhaust gas, the fillers can prevent the backwash air from flowing out through inlet-side portions of the porous thin walls where no combustion residue is accumulated, thereby attaining sufficient removal of the combustion residue.

In the method for performing maintenance of the particulate filter, the filler may be fine particles with mean diameter greater than that of pores of the porous thin walls.

In the method for performing maintenance of the particulate filter, the filler may be a rod with a portion having an outer diameter substantially equal to an inner diameter of the passage.

In the method for performing maintenance of the particulate filter, the filler may be gel material not passing through the porous thin walls.

EFFECTS OF THE INVENTION

A method for performing maintenance of a particulate filter according to the invention can attain excellent effects and advantages such that combustion residue can be reliably removed by means of backwash air without use of hot water and the like while cutting equipment expenses, thereby preventing substantial increase in exhaust pressure and deterioration of fuel economy during an operation.

EXPLANATION OF THE REFERENCE NUMERALS

Figure 1:
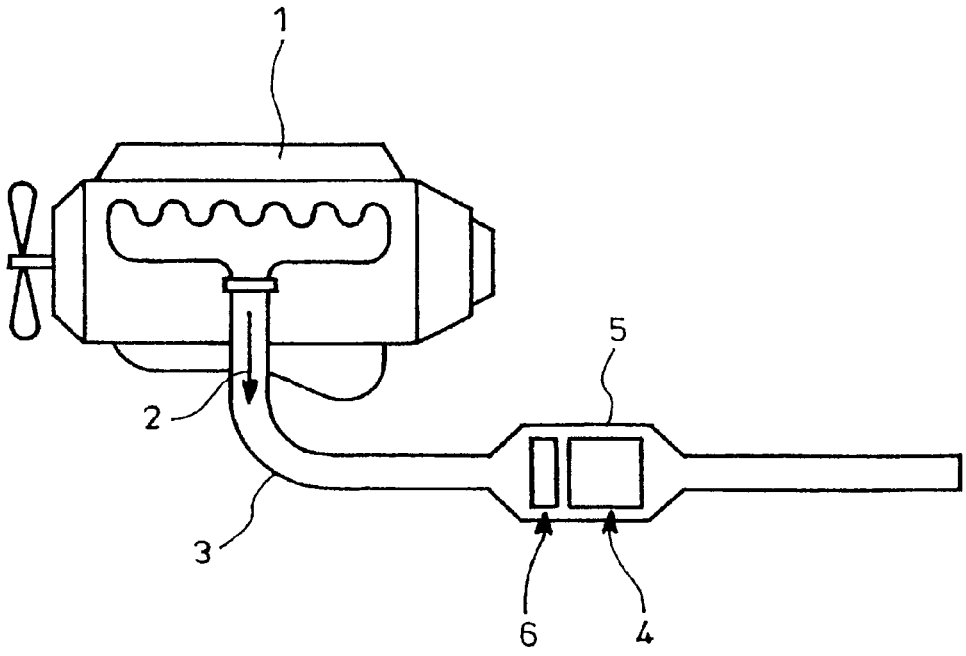
Fig. 1 PRIOR ART
FIG. 1 is a schematic view showing an arrangement of a typical particulate filter.

1 diesel engine
2 exhaust gas
3 exhaust pipe
4 particulate filter
7 filter body
8 passage
9 plug
10 porous thin wall
11 ash (combustion residue)
12 backwash air
13 filler
14 fine particles
15 rod
16 gel material

BEST MODE FOR CARRYING OUT THE INVENTION

Embodiments of the invention will be described in conjunction with the attached drawings.

Embodiment 1

Figure 2:
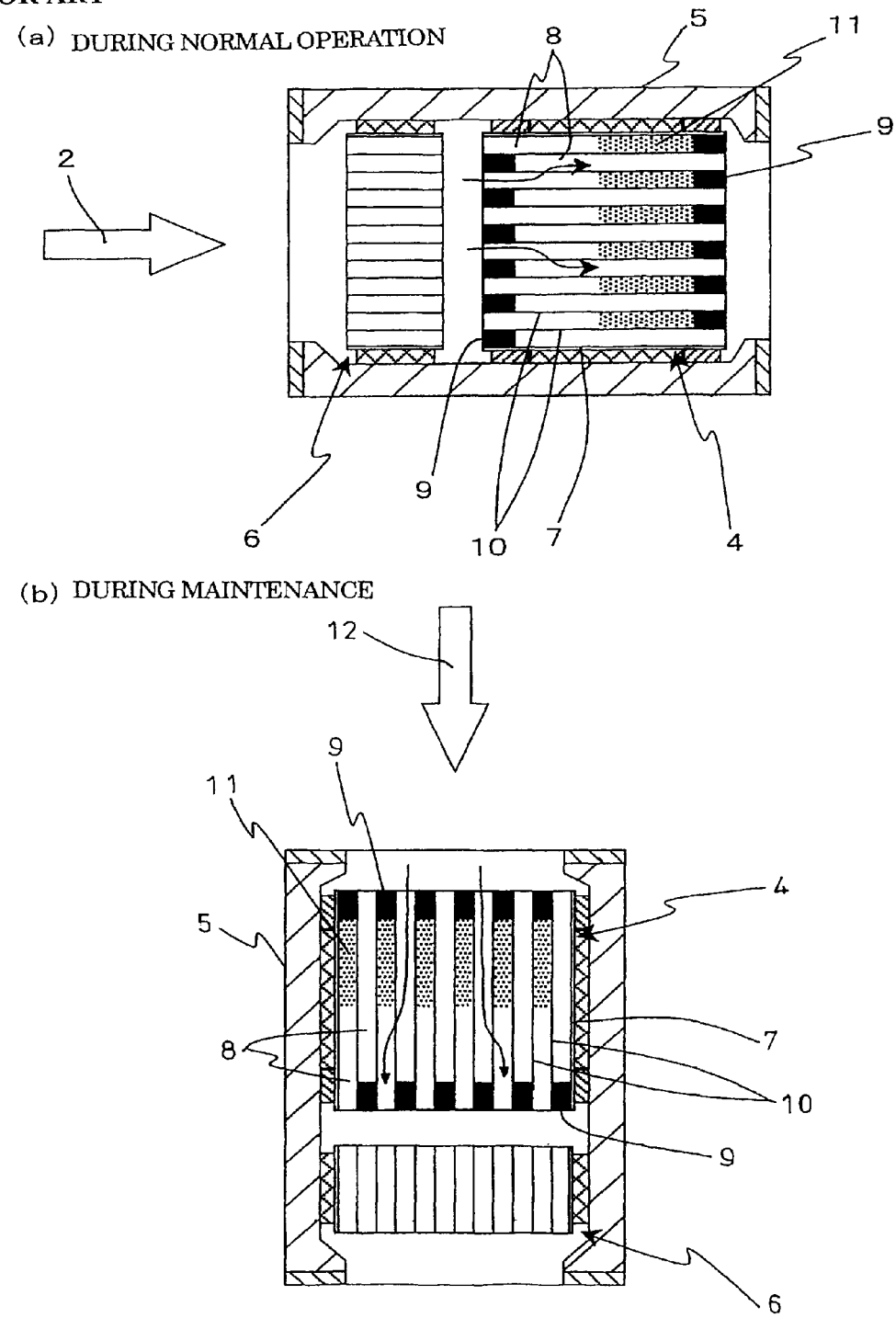
Fig. 2 PRIOR ART
FIG. 2 is sectional views showing a detailed structure of the particulate filter shown in FIG. 1, (a) and (b) being a view showing flow of exhaust gas during a normal operation and a view showing flow of backwash air during maintenance, respectively.
Figure 4:
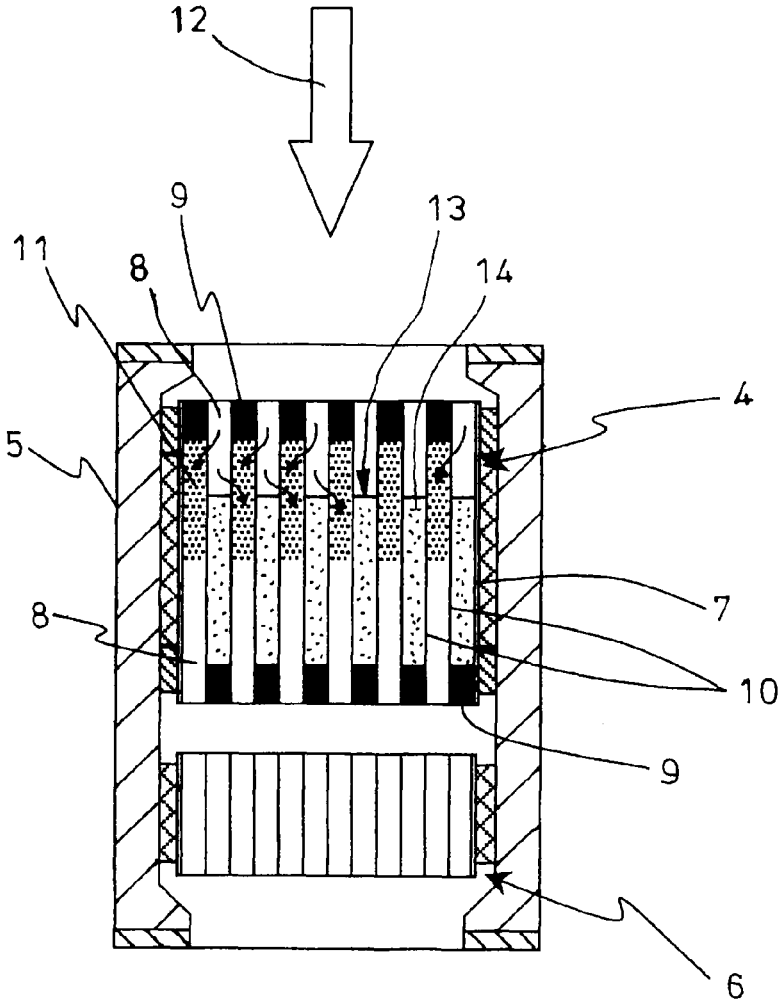
FIG. 4 is a sectional view showing a first embodiment of the invention.

FIG. 4 shows a first embodiment of the invention in which parts similar to those in FIGS. 1 and 2 are represented by the same reference numerals. It is similar in fundamental structure to the conventional one shown in FIGS. 1 and 2 and is characterized in that, as shown in FIG. 4, each of the passages 8 having outlets unplugged with plugs 9 is filled with a filler 13 so as to reduce an inner volume of the passage 8 and then backwash air is blown into the passages 8 having the unplugged outlets.

In the embodiment, the filler 13 is fine particles 14 of, for example, alumina with mean diameter greater than that of pores of the porous thin walls 10.

Next, mode of operation of the above embodiment will be described.

When maintenance of the particulate filter 4 is to be performed, the casing 5 is detached from the exhaust pipe 3 and erected, as shown in FIG. 4, with its downstream end in the direction of flow of the exhaust gas 2 directed upward. And, as mentioned in the above, the fine particles 14 of, for example, alumina are filled as filler 13 to each of the passages 8 with the outlets unplugged with the plugs 9 so as to reduce the inner volume of the passage 8 and then the backwash air 12 is blown into the passages 8 with the unplugged outlets. Thus, the areas of the porous thin walls 10 through which the backwash air 12 can pass are decreased by the fine particles 14 as filler such that the backwash air 12 reliably passes through portions of the thin walls 10 where the ash 11 is accumulated. Therefore, unlike conventional mere blowing of the backwash air 12 through the downstream end of the particulate filter 4 in the direction of flow of the exhaust gas 2, the fine particles 14 as fillers 13 can prevent the backwash air 12 from flowing out through inlet-side portions of the thin walls 10 where no ash 11 as combustion residue is accumulated, thereby attaining sufficient removal of the ash 11.

When the ash 11 is accumulated at an extent shown in FIG. 4, it tends to be considered that the filled height of the fine particles 14 as filler 13 is to be set around a boundary between a portion with the ash 11 accumulated and a portion with no ash accumulated. However, if the filled height of the fine particulates 14 as filler 13 were set to around the boundary, then after removal of the ash 11 around the boundary by the backwash air 12, the backwash air 12 would pass only around the very boundary, failing in removal of the ash 11 accumulated in the outlets of the passages 8 (the upper portions in FIG. 4). Actually, it is preferable for removal of all the ash 11 accumulated that the fine particles 14 as filler 13 are filled to the height as shown in FIG. 4 so as to considerably decrease areas on the porous thin walls 10 through which the backwash air 12 can pass, which fact has been confirmed by actual experiments.

After the removal of the ash 11 as combustion residue is completed, the fine particles 14 as filler 13 may be removed by suction from the passages 8.

Thus, the combustion residue such as the ash 11 can be reliably removed by means of the backwash air 12 without use of hot water and the like while cutting the equipment expenses, thereby preventing substantial increase in exhaust pressure and deterioration of fuel economy during an operation.

Embodiment 2

Figure 5:
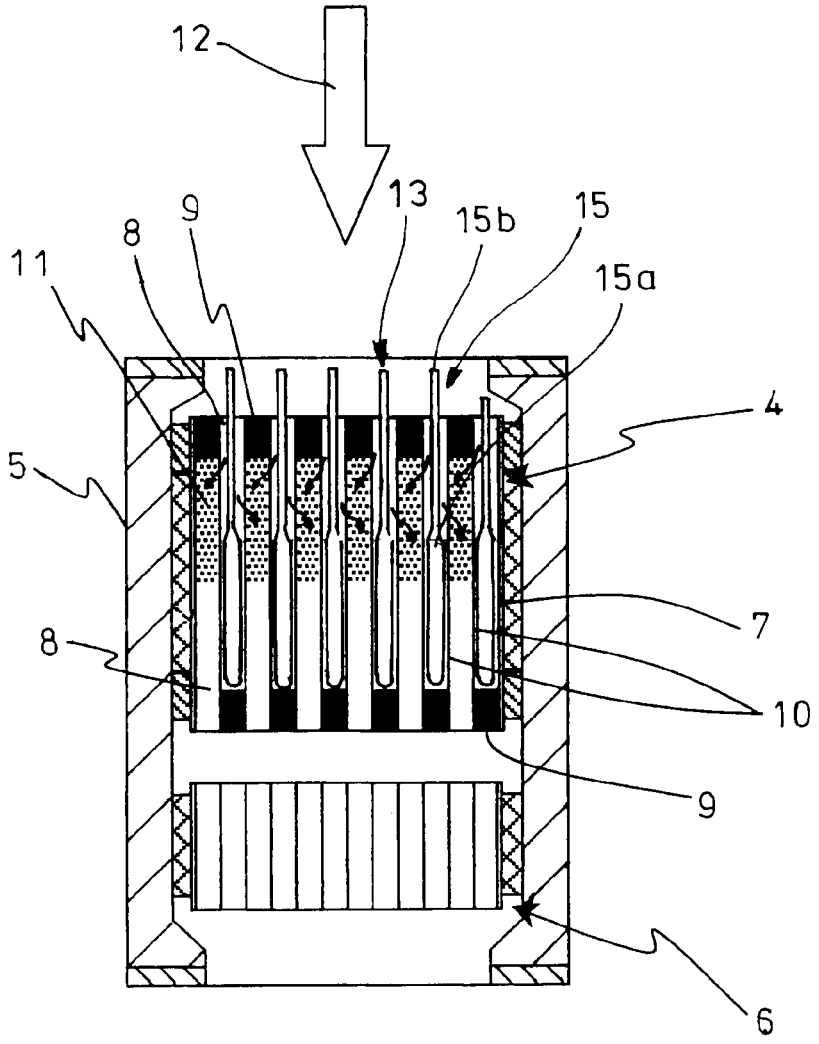
FIG. 5 is a sectional view showing a second embodiment of the invention.

FIG. 5 shows a second embodiment of the invention in which parts similar to those in FIG. 4 are designated by the same reference numerals. When maintenance of a particulate filter 4 is to be performed, in place of the fine particles 14, a rod 15 with a portion having an outer diameter substantially equal to an inner diameter of each of the passages 8 is used as a filler 13 to be filled into each of the passages 8 with outlets unplugged with plugs 9 so as to reduce an inner volume of the passage 8.

The rod 15 is made from, for example, resin, metal or rubber and has a larger-diameter portion 15*a* with an outer diameter substantially equal to an inner diameter of the passage 8 and a smaller-diameter portion 15*b* extending from a base end on and coaxially of the larger-diameter portion 15*a* such that, when the larger-diameter portion 15*a* is inserted to make its tip end abut on the plug 9 in the inlet, the base end of the larger-diameter portion 15*a* is positioned near the outlet of the passage 8 (the upper side in FIG. 5), the areas of the porous thin walls 10 being sufficiently reduced through which backwash air 12 can pass, a base end of the smaller-diameter portion 15*b* being protruded out of the passage 8 by length enough for pinching by fingers.

The rod 15 may be of any shape, provided that it can sufficiently decrease the areas on the porous thin walls 10 through which the backwash air 12 can pass. For example, the rod 15 may have a longitudinally intermediate portion as larger-diameter portion 15*a*, the other portions being smaller-diameter portions 15*b*.

When maintenance of the particulate filter 4 is to be performed in the second embodiment shown in FIG. 5, the casing 5 is detached from the exhaust pipe 3 and erected, as shown in FIG. 5, with its downstream end in the direction of flow of the exhaust gas 2 directed upward. And, as mentioned in the above, the rod 15 is filled as filler 13 to each of the passages 8 with the outlets unplugged with the plugs 9 so as to reduce the inner volume of the passage 8 and then the backwash air 12 is blown into the passages 8 with the unplugged outlets. Thus, the areas of the porous thin walls 10 through which backwash air 12 can pass are decreased by larger-diameter portions of the rods 15 as fillers 13 such that the backwash air reliably passes through portions of the thin walls 10 where the ash 11 is accumulated. Therefore, unlike conventional mere blowing of the backwash air 12 through the downstream end of the particulate filter 4 in the direction of flow of the exhaust gas 2, the rods 15 as fillers 13 can prevent the backwash air 12 from flowing out through inlet-side portions of the thin walls 10 where no ash 11 as combustion residue is accumulated, thereby attaining sufficient removal of the ash 11.

After the removal of the ash 11 as combustion residue is completed, the rods 15 as filler 13 may be taken out through pinching the smaller-diameter portions 15*b*.

Thus, also in the second embodiment shown in FIG. 5, just like the first embodiment shown in FIG. 4, the combustion residue such as the ash 11 can be reliably removed by means of the backwash air 12 without use of hot water and the like while cutting the equipment expenses, thereby preventing substantial increase in exhaust pressure and deterioration of fuel economy during an operation.

Embodiment 3

Figure 6:
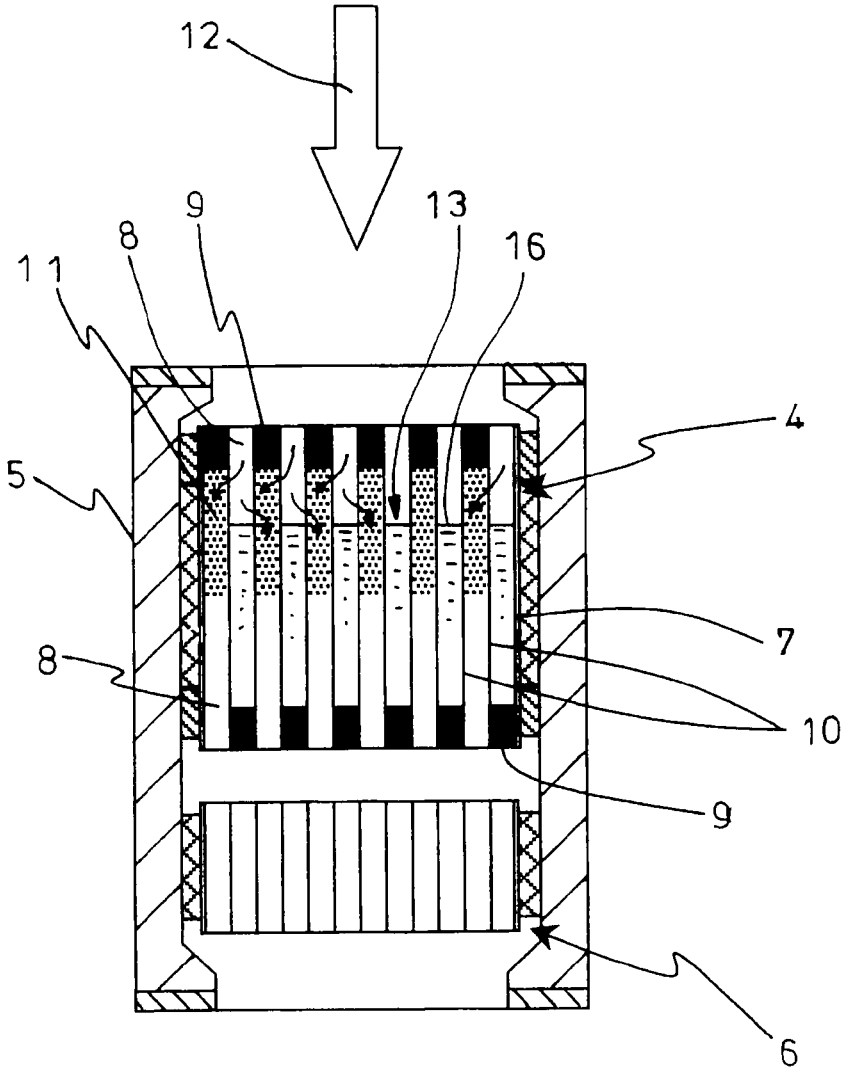
FIG. 6 is a sectional view showing a third embodiment of the invention.

FIG. 6 shows a third embodiment of the invention in which parts similar to those in FIGS. 4 and 5 are represented by the same reference numerals. When maintenance of the particulate filter 4 is to be performed, gel material 16 is substituted for the fine particles 14 or rods 15 as the filler 13 to be filled into each of the passages 8 with the outlets unplugged with the plugs 9 so as to reduce an inner volume of the passage 8.

Any gel material may be used as the gel material 16, provided that it has high viscosity and does not pass through the porous thin walls 10.

When maintenance of the particulate filter 4 is to be performed in the third embodiment shown in FIG. 6, the casing 5 is detached from the exhaust pipe 3 and is erected, as shown in FIG. 6, with its downstream end in the direction of flow of the exhaust gas 2 directed upward and, as mentioned in the above, gel material 16 as the filler 13 is caused to flow and be filled into each of the passages 8 with the outlets unplugged with the plugs 9 so as to reduce an inner volume of the passage 8, and then the backwash air 12 is blown into the passages 8 with the unplugged outlets. Thus, the areas of the porous thin walls 10 through which the backwash air 12 can pass are reduced by the gel material 16 as the filler 13, and the backwash air 12 reliably passes through portions of the porous thin walls 10 where the ash 11 is accumulated. Thus, unlike the conventional mere blowing of the backwash air 12 into the downstream end of the particulate filter 4 in the direction of flow of the exhaust gas 2, the backwash air 12 is prevented by the gel material 16 as filler 13 from flowing out through inlet-side portions of the porous thin walls 10 where no ash 11 as combustion residue is accumulated, thereby attaining substantial removal of the ash 11.

Just like the use of the particles 14, it is preferable for removal of all the ash 11 accumulated that the gel material 16 as filler 13 is filled to height enough for sufficiently decreasing areas on the porous thin walls 10 through which the backwash air 12 can pass.

After the removal of the ash 11 as combustion residue is completed, the gel material 16 as filler 13 may be removed from the passage 8 by suction.

Thus, also in the third embodiment shown in FIG. 6, just like the first and second embodiments shown in FIGS. 4 and 5, respectively, the combustion residue such as ash 11 can be reliably removed by means of the backwash air 12 without use of hot water and the like while cutting equipment expenses, thereby preventing substantial increase in exhaust pressure and deterioration of fuel economy during an operation.

Figure 3:
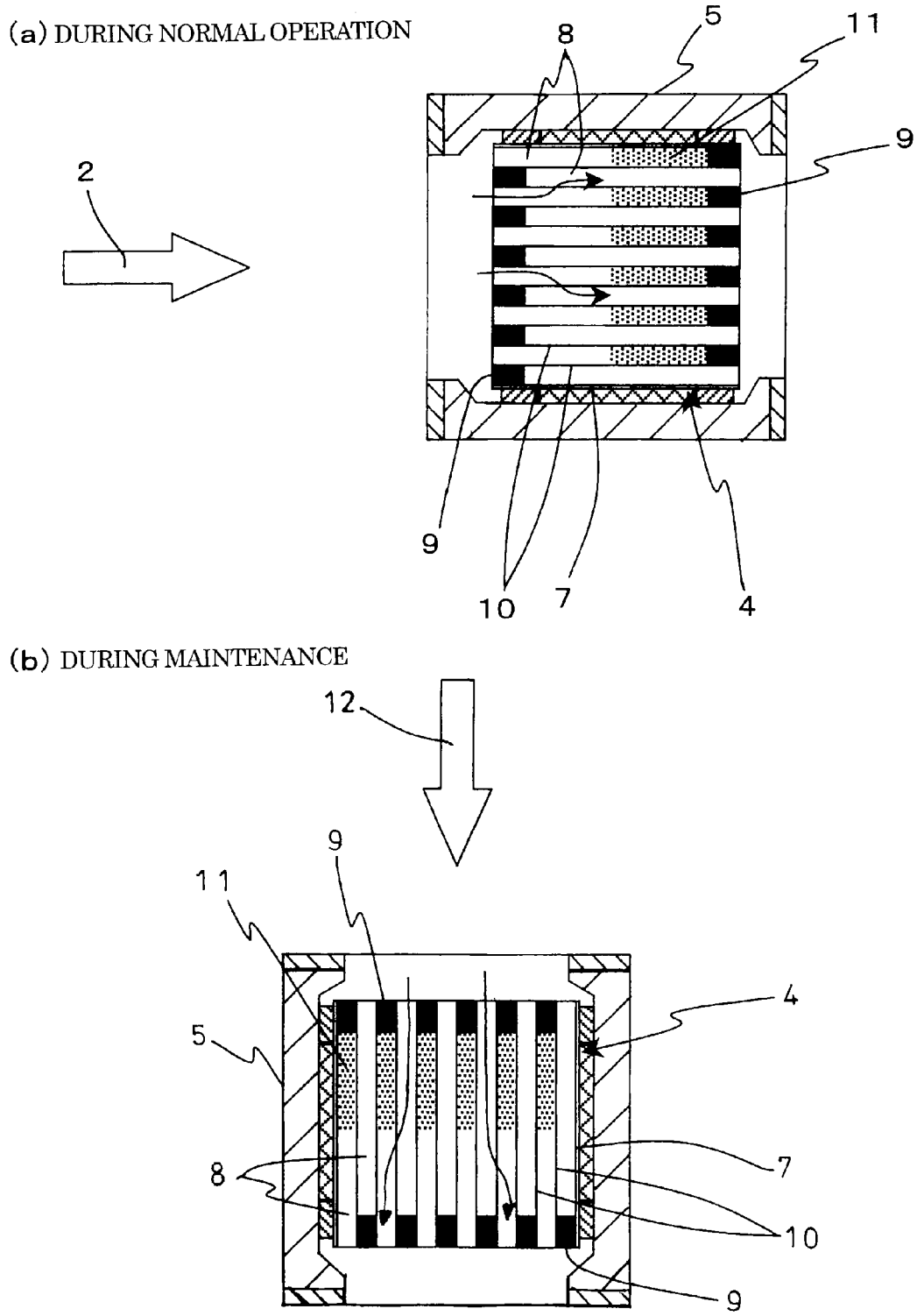
FIG. 3 is sectional views showing a detailed structure of a particulate filter with no fore oxidation catalyst being arranged, (a) and (b) being a view showing flow of exhaust gas during a normal operation and a view showing flow of backwash air during maintenance, respectively.

It is to be understood that a method for performing maintenance of a particulate filter according to the invention is not limited to the above-mentioned embodiments and that various changes and modifications may be made without leaving the spirit of the invention. For example, the invention may be applicable not only to the particulate filter 4 with the fore oxidation catalyst 6 arranged in an entry side of the particulate filter 5 in the casing 5, but also to, as shown in (a) and (b) of FIG. 3, the particulate filter 4 with no fore oxidation catalyst 6 arranged on the entry side of the particulate filter 5 in the casing 5.

The invention claimed is:

1. A method comprising:

obtaining a particulate filter, said particulate filter including a honeycomb filter body made of porous material with mutually adjacent passages with plugged inlets and passages with plugged outlets, and said particulate filter including particulates captured from exhaust gas;

filling, in the particulate filter including particulates captured from the exhaust gas, each of the passages with unplugged outlets with a filler material so as to reduce an inner volume of the passages, wherein the filter material is fine particulates with a mean diameter larger than that of pores of porous thin walls of the particulate filter;

wherein the filling includes filling the passages with unplugged outlets so that the filler material to a height over that of a lower boundary of the particulates captured from the exhaust gas when the particulate filter is oriented with its downstream end in a direction of flow of exhaust gas directed upward; and blowing backwash air into said passages with the unplugged outlets that include the filler material.

2. The method for performing maintenance of the particulate filter as claimed in claim 1, wherein the filler material is alumina.

3. The method for performing maintenance of the particulate filter as claimed in claim 1, further comprising:

after the blowing, removing the filler material from the passages with the unplugged outlets.

4. The method for performing maintenance of the particulate filter as claimed in claim 3, wherein the removing includes using suction.

* * * * *